US009162102B1

(12) United States Patent
Eder et al.

(10) Patent No.: US 9,162,102 B1
(45) Date of Patent: Oct. 20, 2015

(54) FITNESS MACHINE WITH WEIGHT SELECTION AND WEIGHT INDICATOR

(71) Applicant: IncludeFitness, Inc., Cincinnati, OH (US)

(72) Inventors: James Ryan Eder, Columbus, OH (US); Jamison Joseph Float, Galloway, OH (US)

(73) Assignee: IncludeFitness, Inc., Cincinnati, OH (US)

( * ) Notice: Subject to any disclaimer, the term of this patent is extended or adjusted under 35 U.S.C. 154(b) by 94 days.

(21) Appl. No.: 14/166,707

(22) Filed: Jan. 28, 2014

Related U.S. Application Data

(60) Provisional application No. 61/757,484, filed on Jan. 28, 2013.

(51) Int. Cl.
*A63B 21/06* (2006.01)

(52) U.S. Cl.
CPC ..... *A63B 21/06* (2013.01)

(58) Field of Classification Search
CPC ..... A63B 21/00
USPC ..... 482/98, 99, 102
See application file for complete search history.

(56) References Cited

U.S. PATENT DOCUMENTS

| | | | |
|---|---|---|---|
| 4,746,113 | A | 5/1988 | Kissel |
| 5,037,089 | A | 8/1991 | Spagnuolo et al. |
| 5,104,120 | A | 4/1992 | Watterson et al. |
| 5,350,344 | A | 9/1994 | Kissel |
| 5,383,826 | A | 1/1995 | Michael |
| 5,643,151 | A | 7/1997 | Naimo |
| 6,015,367 | A | 1/2000 | Scaramucci |
| 7,429,236 | B2 | 9/2008 | Dalebout et al. |
| 7,473,211 | B2 | 1/2009 | Lee |
| 7,485,076 | B2 | 2/2009 | Lee |
| 7,507,189 | B2 | 3/2009 | Krull |
| 7,662,070 | B1 | 2/2010 | Mann |
| 7,717,824 | B2 | 5/2010 | Pinto |
| 7,722,509 | B2 | 5/2010 | Eder |
| 7,938,762 | B2 | 5/2011 | Nishimura |
| 7,995,038 | B2 | 8/2011 | Vitale et al. |
| 8,280,536 | B1 | 10/2012 | Fadell et al. |
| D687,047 | S | 7/2013 | Hales, IV et al. |
| 2006/0172858 | A1 | 8/2006 | Chen |
| 2008/0176713 | A1 | 7/2008 | Olivera Brizzio et al. |
| 2011/0009239 | A1 | 1/2011 | Whelan, Jr. |
| 2011/0195823 | A1 | 8/2011 | Lee |
| 2013/0237390 | A1 | 9/2013 | Lo |
| 2013/0296142 | A1 | 11/2013 | Robertson et al. |

*Primary Examiner* — Jerome w Donnelly
(74) *Attorney, Agent, or Firm* — Jason H. Foster; Kremblas & Foster

(57) ABSTRACT

A means and method for automatically selecting an amount of weight to be connected to a cable system in a fitness machine. When a dial is rotated to select a weight, a connected computer receives the rotational position information, operates a program to determine the amount of each weight to attach to the cable system and actuates solenoids accordingly to attach the weight to the cable by inserting pins fully into weight stacks to connect weights to a rod connected to a cable. The computer also displays the selected weight on the dial. When the new weight is selected, one or more retracting solenoids draw any inserted pins partially out before any new pins are fully inserted to connect the weights to the rod. This ensures that the system is cleared before attaching any weights to the cable.

2 Claims, 5 Drawing Sheets

Fig. 2
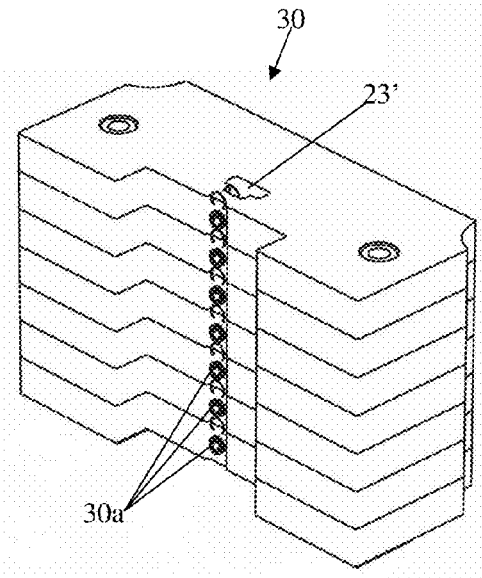
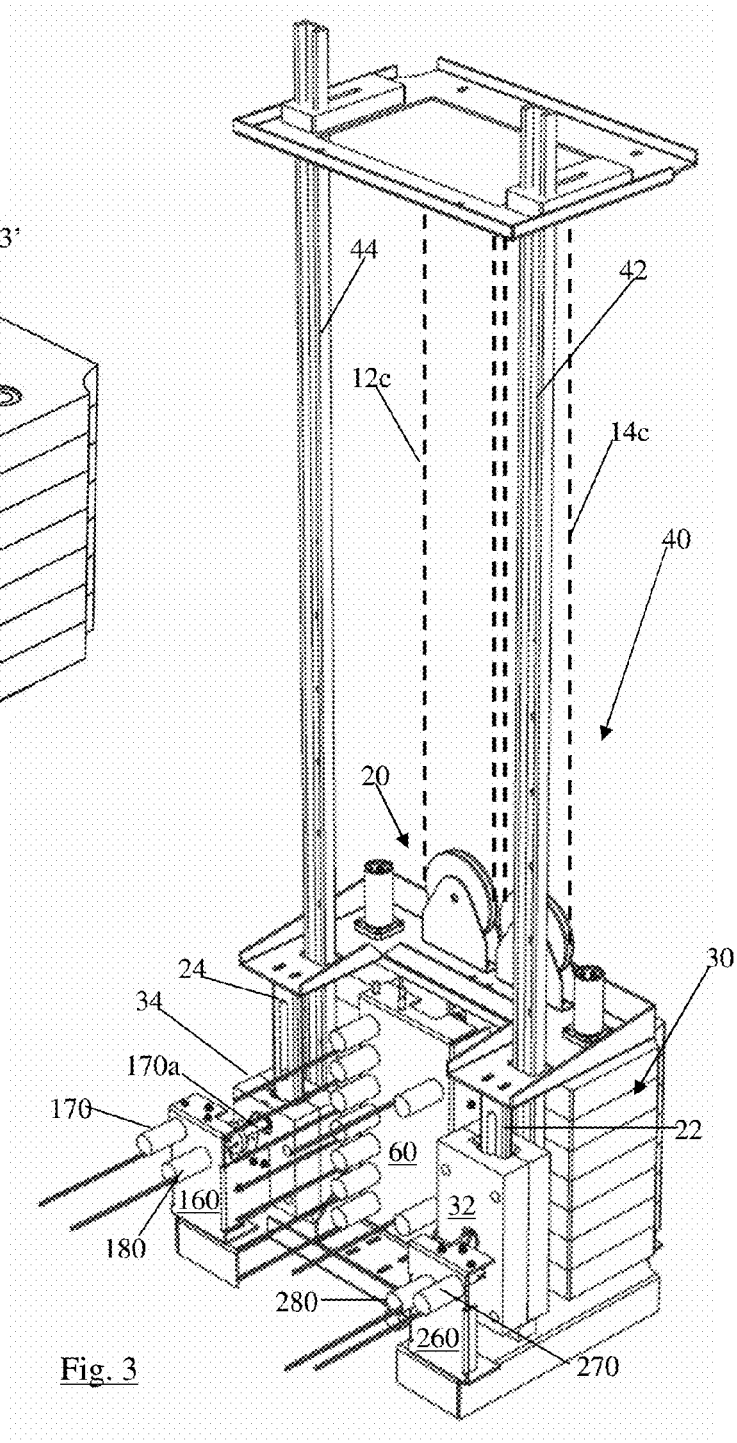
Fig. 3

FITNESS MACHINE WITH WEIGHT SELECTION AND WEIGHT INDICATOR

BACKGROUND OF THE INVENTION

The invention relates generally to fitness equipment, and more specifically to fitness equipment that mechanically links to one or more plates in a weight plate stack after a user selects the desired amount of weight to be lifted by the user.

There are various types of activities that people can engage in to enhance physical fitness. Many types of fitness devices have been invented to aid people in their quest for physical fitness, and these range from the simple barbell to the mechanically complex cable, pulley and weight stack machines. In the latter, a series of stacked weights aligned with a rod extending vertically therethrough are lifted by the user through one or more cables extending through pulleys attached at one end to the rod and at the opposite end to a handle. The user selects the position of the handle in order to correctly match the lifting routine and body size, and the user selects the amount of weight appropriate to his or her fitness level in the routine.

Conventional means for selecting the amount of weight include a T-shaped pin that inserts between two of the cast iron plates in the stack and into an aligned aperture in the rod. Because the pin is placed beneath one of the plates and into the rod, when the rod is raised by pulling on the cable, the weight plates above the pin are lifted with the rod. To remove the pin from the stack, one typically lowers the weights and then presses a button at the intersection of the "legs" of the "T". This allows the pin to be withdrawn from the aperture in the rod, for example by reducing the diameter of the pin by moving radially inwardly a small ball that otherwise protrudes from the shaft of the pin.

While those with the ability to grasp the handle and press the button on such T-shaped pins take for granted their ability to carry out the procedure needed to withdraw such a pin, a significant portion of the population is not capable of carrying out this procedure. Fitness machines listed in the Invention Disclosure Statement have been invented to allow users who are not able to carry out this procedure to avoid such machines. However, such prior art machines suffer from various weaknesses that hinder their use. Therefore, the need exists for a fitness machine with a weight stack that permits quick and accurate change of weight and display of the selected weight.

BRIEF SUMMARY OF THE INVENTION

The present invention contemplates a method and apparatus for electromechanically selecting a specified resistance through a rotational interface used by a human operator. The preferred system components include a dial that is used to select a quantity of resistance, and also displays the quantity selected. A weight stack, or a selected portion thereof, is raised and lowered by the human user according to the quantity of resistance selected using the dial. A pin insertion assembly is actuated by a computer, using the information received from the dial in a program that is designed to mechanically link the selected weight with a cable that a human interface attaches to for lifting the weight. Preferably, a plurality of solenoids is used to drive a plurality of pins into apertures between the weights and into aligned apertures in a rod to which the cable attaches. When the dial is rotated, a system of gears engages a potentiometer to determine the specified resistance based on dial orientation. This information is processed by the computer and the computer actuates the appropriate solenoid for the selected weight.

The solenoids are mounted to a tower in an array of actuator solenoids and retraction solenoids. Each actuator solenoid is coupled to a corresponding array of pins through a linkage system. When an actuator solenoid is actuated by the computer, the linkage translates the corresponding pin into the weight stack to engage the weight, which enables the specified weight to travel with the cable. When a new resistance is specified by rotating the dial, the retraction solenoids are first actuated to engage a reset bar, which, through a linkage system, removes any pin engaged in the weight stack. After retraction is completed, the respective actuator solenoid is actuated by the computer according to the specified resistance.

BRIEF DESCRIPTION OF THE SEVERAL VIEWS OF THE DRAWINGS

FIG. 2 is a view in perspective illustrating a weight plate stack that can be used in the present invention.

FIG. 3 is a view in perspective illustrating a weight selection mechanism for connecting one or more weights in the weight stack with an apparatus that is lifted by cables pulled by a user.

Figure 1:
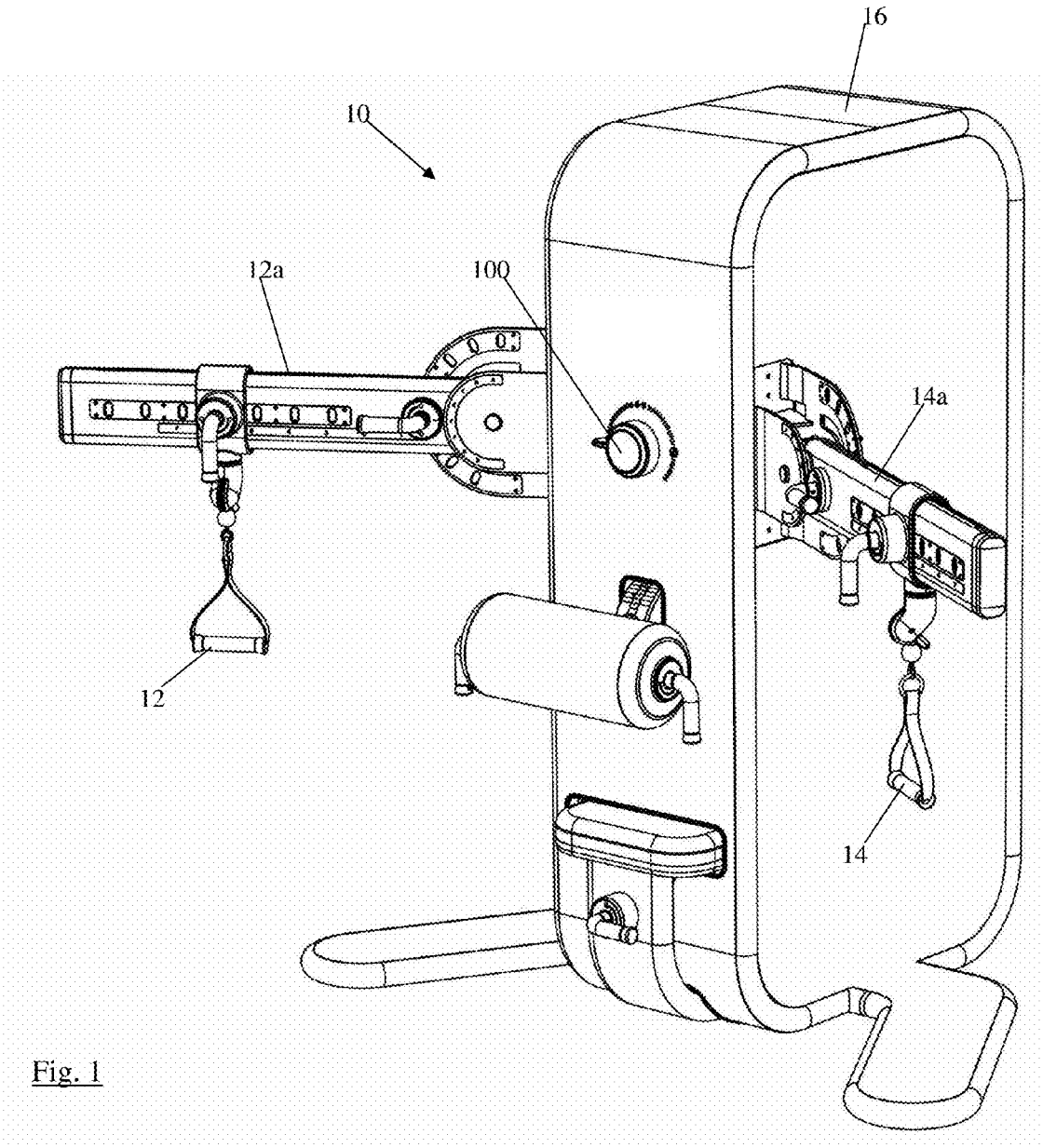
FIG. 1 is a view in perspective of a fitness machine in which the present invention can be used.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Provisional patent application Ser. No. 61/757,484, filed Jan. 28, 2013, which is the above claimed priority application, is incorporated in this application by reference.

The fitness machine 10 shown in FIG. 1 is the type of device contemplated for use of the present invention. The invention is not limited to use in the machine 10 shown in FIG. 1, but the machine 10 is illustrated and discussed herein so that a person of ordinary skill will understand the present invention. From the description, a person of ordinary skill will know how to adapt the invention to any suitable fitness machine.

A weight selection mechanism 40 shown in FIG. 3 is housed in the central housing 16 of FIG. 1, but is not visible in FIG. 1. The hand-grippable handles 12 and 14, or some other human interface, are attached to flexible cables 12*c* and 14*c* (shown in broken lines in FIG. 3), which extend through the arms 12*a* and 14*a* into the central housing 16. The cables 12*c* and 14*c* are attached to a cable connector/pulley apparatus 20 (see FIG. 3), which connects to one or more weight plates in the weight stack 30 as described in more detail below. Thus, through the cable connections, a user can pull on the handles 12 and 14, which results in lifting of the apparatus 20. The cable is referred to herein as a "flexible thread", and this term is used broadly to encompass any wire rope-like structure or any structure that could replace a wire rope, including without limitation, synthetic rope, chain, flexible wire.

The weight selection mechanism 40 includes the weight stacks 30, 32 and 34 and a pair of vertical bars 42 and 44 that extend along one side of the weight stack 30 and are used for guidance during vertical displacement of the apparatus 20. The cable connector/pulley apparatus 20 rests on the top of the weigh stack 30 and has three rods 22, 23 and 24 that extend downwardly from the apparatus 20 and into the weight stacks 32, 30 and 34, respectively. The terms "up", "down", "upward", "downward", and other terms of orientation are used herein. These terms are relative to the position and orientation of the structures of the machine 10, and, unless indicated otherwise, are used in relation to the orientation of the machine 10 of FIG. 1. If this orientation is changed, a person of ordinary skill will understand how to modify the orientation of related components.

The cables 12*c* and 14*c* connect the handles 12 and 14 to the apparatus 20 so that upon pulling the handles 12 and 14, the apparatus 20 is raised from the position shown in FIG. 3 along the vertical bars 42 and 44. Any weights connected to the apparatus 20, such as by pins described below, are lifted by the cables 12*c* and 14*c* when the apparatus 20 is lifted. The means by which the apparatus 20 is connected to one or more of the weights in the weight stacks 30, 32 and 34 will now be described.

Figure 4:
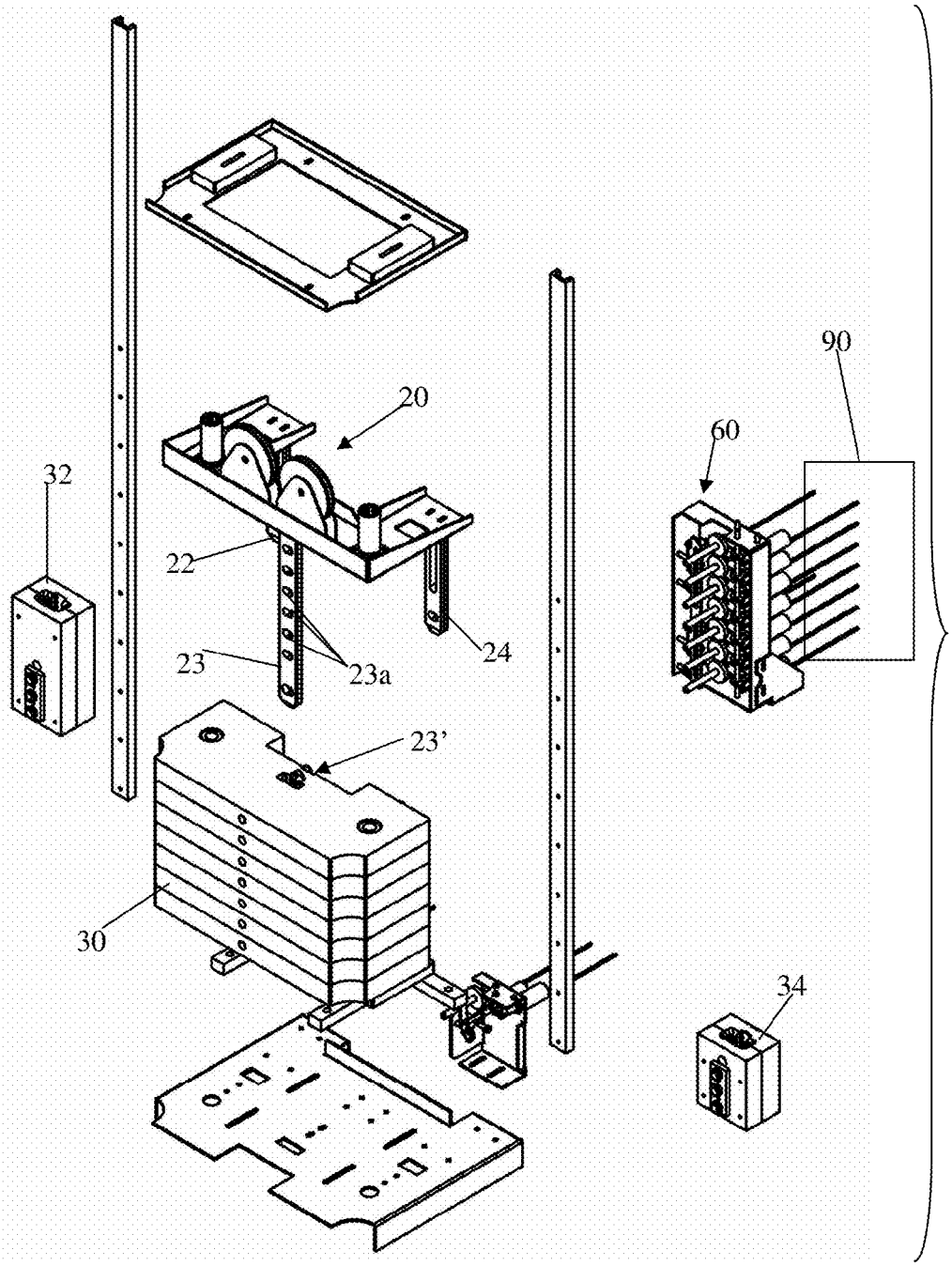
FIG. 4 is an exploded view in perspective illustrating the weight selection mechanism shown in FIG. 3.

The rod 23 has a plurality of apertures 23*a* formed therein (see FIG. 4). When the rod 23 is inserted downwardly into the opening 23' in the weight stack 30 as shown in FIG. 3, the apertures 23*a* align with the apertures 30*a* (see FIG. 2) in the weight stack, thereby allowing a pin that is aligned with the corresponding apertures 30*a* in the weight stack to be further inserted therein through the remainder of the aligned apertures 30*a* in the weight stack and through one of the aligned apertures 23*a* in the rod 23. Because the inserted pin connects the weight to the rod 23, any weight plates in the stack 30 above the pin are lifted with the apparatus 20.

Figure 5:
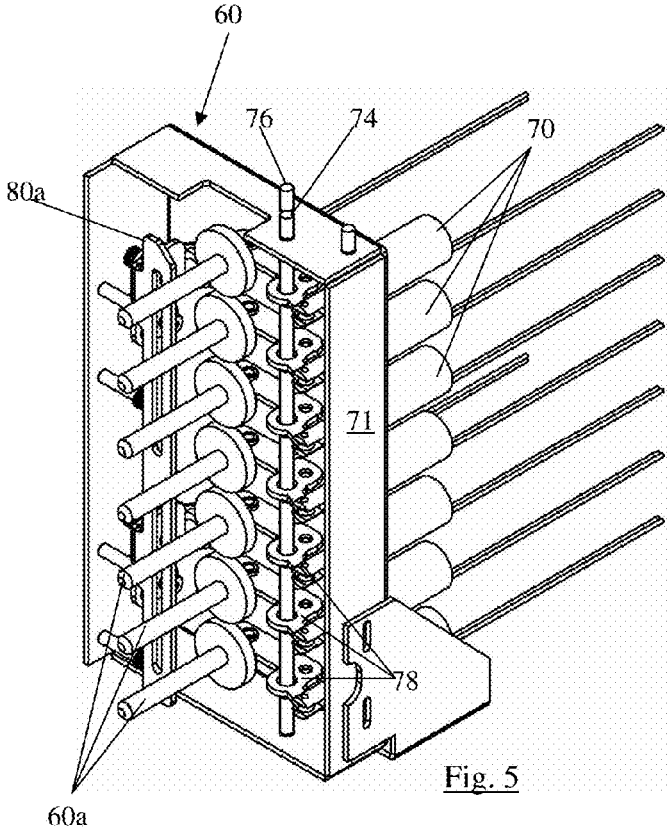
FIG. 5 is view in perspective illustrating the preferred pin insertion assembly.
Figure 6:
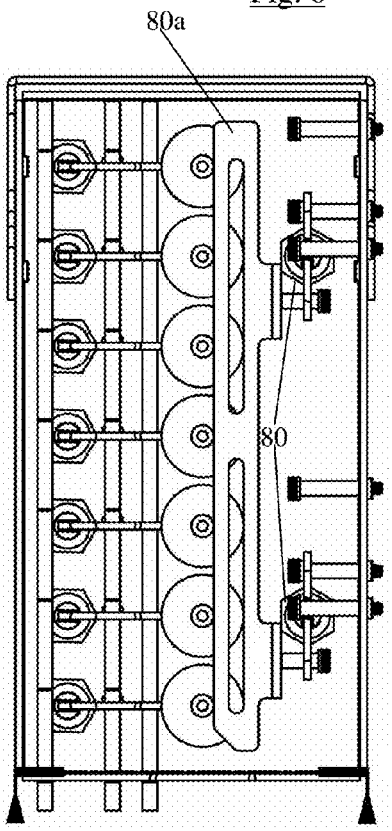
FIG. 6 is a rear view illustrating the pin insertion assembly of FIG. 5.

The pin insertion assembly 60, which is part of the weight selection mechanism 40 as shown in FIG. 3, is disposed at the side of the weight stack 30 where the apertures 30*a* are formed, and is preferably mounted to the base of the mechanism 40. This configuration allows all of the multiple pins 60*a* (see FIG. 5) mounted on the pin insertion assembly 60 to be partially inserted into a corresponding one of the apertures 30*a* at all times, and then, at the desired time, one of the pins is inserted further so that it extends through a respective aperture 23*a* of the rod and the remainder of the aperture 30*a*, in order to thereby connect the rod 23 to the weights in the stack 30. Multiple prime movers, which are preferably actuator solenoids 70, are mounted to a frame 71 and are connected to the computer 90 using wiring, wireless connections or any other means. The computer can be a general purpose, programmable computer, programmed logic circuit (PLC) or any conventional device suitable for the purposes described herein.

Figure 7:
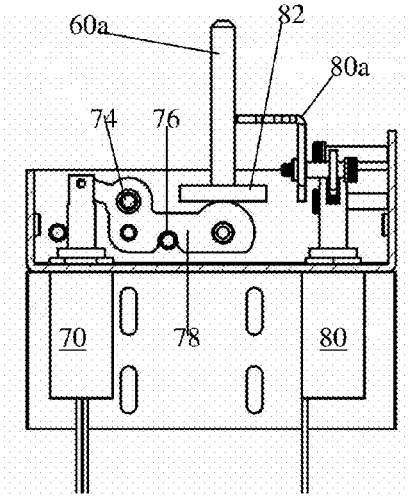
FIG. 7 is a top view illustrating the pin insertion assembly of FIG. 5.

Two shafts 74 and 76 are mounted to the frame 71. Each of the solenoids 70 extends to a pivotal connection with a respective linkage 78, which is preferably a flat metal plate with an aperture through which the shaft 74 extends to form a pivot. Upon actuation of one of the solenoids 70 as instructed by the computer 90 to withdraw its driveshaft from the position shown in FIG. 7, the linkage 78 is driven to pivot counterclockwise about the shaft 74, forcing the respective pin 60*a* to be extended upwardly in the orientation of FIG. 7, which is in the direction of an associated aperture 30*a* in the weight stack 30 and an aligned aperture 23*a* in the rod 23. The pin 60*a* so driven, extends through the aligned aperture 23*a* in the rod 23, and then through the remainder of the aperture 30*a*. In the inserted position, the respective pin 60*a* connects at least one weight in the stack 30 to the apparatus 20, thereby enabling any weights above the respective pin to travel with the apparatus 20. When the weight or weights are lifted, the pin insertion assembly 60 remains adjacent the portion of the weight stack 30 that is not lifted, but the pin that extends through the rod 23 is lifted with the rod. Each linkage 78 is limited in how far it can be displaced away from the weight stack 30 by the shaft 76 that fits into a groove at one side of the linkage 78.

Each pin 60*a* has a shoulder 82 that seats against a reset bar 80*a* that is drivingly linked to the retraction solenoids 80, which are also connected to the computer 90. Upon actuation of the retraction solenoids 80 by instruction of the computer 90, the reset bar 80*a* is pulled away from the weight stack (downwardly in the illustration of FIG. 7), thereby withdrawing any pin 60*a* that is fully inserted into the entire aperture of the weight stack 30 and into the rod 23 by pulling the shoulders 82 of such pin 60*a* so that the pin 60*a* is only partially extending through the aperture 30*a* and not through the rod 23. Once this withdrawal occurs, the mechanism 40 is reset and there is no pin in any rod aperture 23*a*, which means there are no weights connected to the apparatus 20 and the cables 12*c* and 14*c*.

The secondary weight stacks 32 and 34 operate in a similar manner to the weight stack 30, except that there are not multiple weights to select among. Instead, the single weight in the secondary weight stacks 32 and 34 are either selected or it is not. The weight stack 34 preferably weighs 10 pounds, which, due to the mechanical advantage provided by the pulley arrangement, provides 5 pounds of resistance to a user pulling on the cable. The pin insertion assembly 160 is very similar to the pin insertion assembly 60 except that the assembly 160 has only one actuator solenoid 170 connected to the computer 90 for inserting a pin 170*a* completely into a single aperture through the weight stack 34 and an aperture in the rod 24 to connect the weight stack 34 to the rod 24. A retraction solenoid 180 is also connected to the computer 90 and withdraws the pin 160*a* using a single linkage (not visible) substantially identical to the linkage 78.

The weight stack 32 is preferably 20 pounds in weight, which, due to the mechanical advantage provided by the pulley arrangement, provides 10 pounds of resistance to a user pulling on the cable. The pin insertion assembly 260 is very similar to the pin insertion assembly 60 except that it has only one solenoid 270 connected to the computer 90 for inserting a pin (not visible) completely into a single aperture through the weight stack 32 and an aperture in the rod 22 to connect the weight stack 32 to the rod 22. A retraction solenoid 280 is connected to the computer 90 and withdraws the pin using a single linkage (not visible) substantially identical to the linkage 78. Thus, using the weight stacks 32 and 34, five, ten or fifteen pounds can be added to each plate or set of plates in the weight stack 30, each of which preferably weighs 40 pounds with effective resistance of 20 pounds after the mechanical advantage provided by the pulley connection.

It should be understood that the exact weight of each plate, and the number of combinations thereof, is not critical to the function of the weight selection apparatus 40. Furthermore, there can be any desired and feasible number of weight stacks. The amount of weight that can be selected on the machine 10 preferably ranges from ten to 150 lbs by increments of five pounds, but this amount could be modified and still include the inventive features described herein. The amounts and combinations are described herein as examples, and a person having ordinary skill in the technology will understand from the explanation how to adapt the invention to any weight stack or weight amount.

Figure 8:
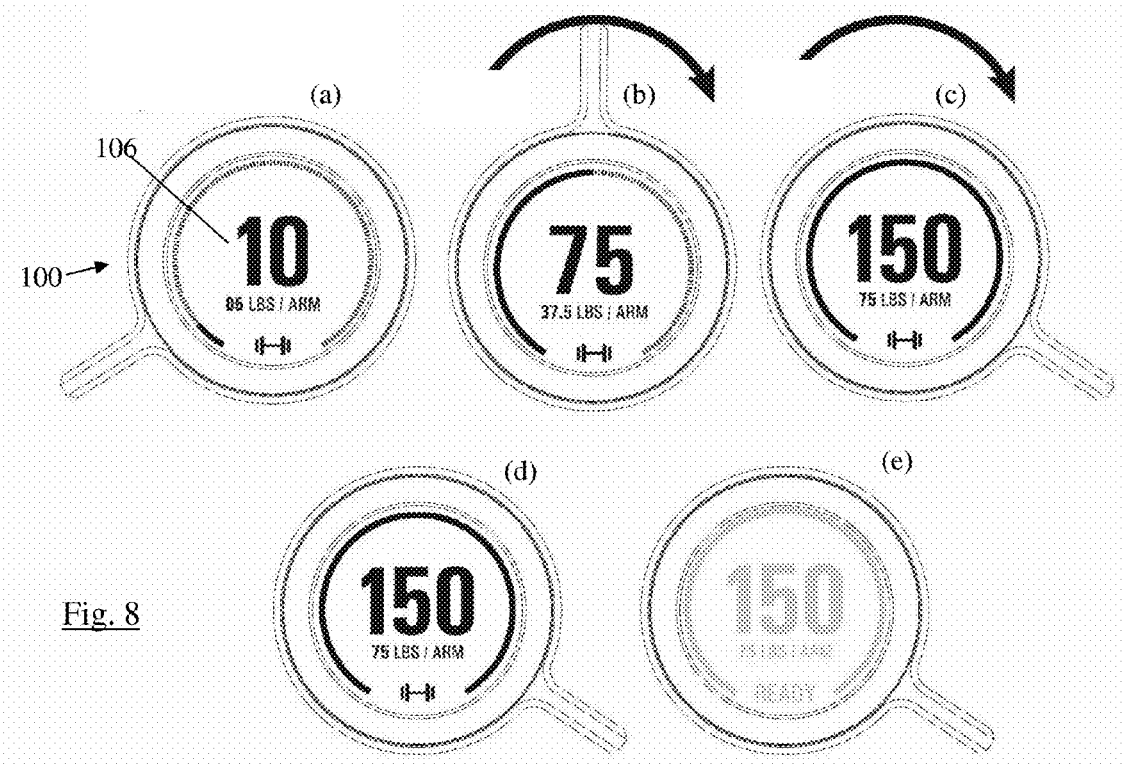
FIG. 8 is a front view illustrating a preferred weight selection dial through a sequence of movements of the dial.
Figure 9:
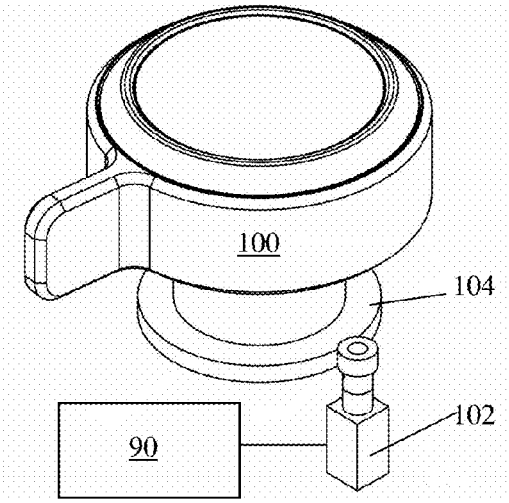
FIG. 9 is a schematic view in perspective illustrating the preferred weight selection dial mechanism.

The preferred means by which the weight selection mechanism 40 is actuated is shown in FIGS. 1 and 8-9. The dial 100 is mounted on the face of the fitness machine 10, preferably between about chest and eye levels. The dial 100 is shown in FIG. 8 having a display 106 on its face, which is preferably an electronic display, such as a liquid crystal display (LCD), light-emitting diodes (LED), or equivalent visual image-forming apparatus that is human-perceivable.

The dial 100 is shown in FIG. 9 connecting to a potentiometer 102 that is electrically or otherwise connected to the computer 90. A gear 104 is an extension of the dial 100, but could be linked through a drive mechanism. Upon rotation of the dial 100 in one direction or another about a central axis through its cylindrical body, the gear 104 rotates the potentiometer 102, and the position of the gear 104 determines the signal the potentiometer 102 sends to the computer 90 to which all solenoids in the machine 10 are connected. Upon receipt of the signal from the potentiometer 102 indicating the position of the dial 100, the computer 90 calculates the combination of available weights that equals the amount associated with the position of the dial, and the display 106 displays the amount of weight associated with the position of the dial.

An example of this is shown in FIG. 8 at position (a) as the dial 100 is rotated clockwise from 10 lbs through 75 lbs at position (b) and further to 150 lbs at position (c). The rotation is stopped at position (d) and the computer 90 detects the halting of rotation as the signal to determine, from the amount of weight that has been selected, which actuators should be extended to connect the combination of weights to the apparatus 20. Once the computer has determined the combination of weights based on programming code that is suited to the particular machine 10 the system is used with, the computer 90 actuates the retraction solenoids 80, 180 and 280 on the weight stacks 30, 32 and 34, thereby withdrawing any pins that connect a weight to the apparatus 20. This occurs on all weight stacks whether any pins are inserted or not, just to be certain that any pins are withdrawn. Next, the solenoids 70, 170 and/or 270 that are associated with the appropriate pins for the weight combination determined are actuated by the computer 90 to insert the desired pins through the rods 22, 23 and/or 24, thereby connecting the selected amount of weight to the apparatus 20.

Once the selected weight is connected to the apparatus 20, which typically will take on the order of a few seconds from stopping the rotation of the dial 100, the display of the dial 100 preferably indicates that the machine 10 is ready, such as by changing the color of the displayed text to green or some other color. During rotation of the dial 100, the display can be blank, or the color of the numbers can be displayed in a different color, such as red or black. The type of indication can vary from a color change, but in any case it is preferred that the display 106 indicate in a human-perceptible manner (visible, audible, etc.) that the machine 10 is ready for use because the desired amount of weight has been connected to the machine's handles.

It should be noted that the method of clearing and then selecting weight can be varied from that described above. For example, the pins inserted can be removed when the machine 10 is idle for a predetermined period of time and the dial 100 and display 106 are reset. For safety purposes, it is desirable that no solenoids be actuated while the machine 10 is in use. Therefore, sensors are used to detect the position of the apparatus 20 relative to the weight stack 30, and if the apparatus 20 is in a "home" position resting upon the weight stack, the computer 90 can actuate solenoids to insert or withdraw pins. If not, the computer 90 waits until the home position is achieved before actuating solenoids.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An apparatus for mechanically linking an amount of weight in a fitness machine to at least one flexible, elongated thread mounted at one end to a human interface and at an opposite end to a device that is attachable to various quantities of weight for raising a quantity of weight against the force of gravity using the human interface, the apparatus comprising:

(a) at least first and second stacked weights through which a rod extends, the rod having at least first and second apertures formed therethrough, wherein the first rod aperture is aligned with an aperture formed between the first and second weights and the second rod aperture is aligned with an aperture formed below the second weight;

(b) a pin insertion assembly disposed adjacent the weights, the assembly including:

(i) at least a first pin drivingly linked to a first prime mover, the first pin being aligned with the first rod aperture and the aperture formed between the first and the second weights for insertion of the first pin into its respective aligned apertures upon actuation of the first prime mover;

(ii) at least a second pin drivingly linked to a second prime mover, the second pin is aligned with the second rod aperture and the aperture formed below the second weight for insertion of the second pin into its respective aligned apertures upon actuation of the second prime mover; and (iii) at least a third prime mover mounted to a reset bar that is adjacent the first and second pins for retracting from insertion any of the first and second pins upon actuation of said at least a third prime mover;

(c) a dial on a visible region of the fitness machine, the dial being rotatable about an axis and having a display perceptible by a human user; and (d) a computer connected to the dial and said first, second and third prime movers for receiving information from the dial regarding dial orientation, for sending display information to the dial, and for actuating one of the first and second prime movers to insert one of said at least first and second pins into a respective one of the apertures.

2. A method of mechanically linking an amount of weight in a fitness machine to at least one flexible, elongated thread mounted at one end to a human interface and at an opposite end to a device that is attachable to various quantities of weight for raising a quantity of weight against the force of gravity using the human interface, the method comprising:

(a) extending a rod having at least first and second apertures formed therethrough through at least first and second stacked weights to align the first rod aperture with an aperture formed between the first and second weights and the second rod aperture with an aperture formed below the second weight;

(b) disposing a pin insertion assembly adjacent the weights, the assembly including:

(i) at least a first pin drivingly linked to a first prime mover, the first pin being aligned with the first rod aperture and the aperture formed between the first and the second weights for insertion of the first pin into its respective aligned apertures upon actuation of the first prime mover;

(ii) at least a second pin drivingly linked to a second prime mover, the second pin is aligned with the second rod aperture and the aperture formed below the second weight for insertion of the second pin into its respective aligned apertures upon actuation of the second prime mover; and (iii) at least a third prime mover mounted to a reset bar that is adjacent the first and second pins for retracting from insertion any of the first and second pins upon actuation of said at least a third prime mover;

(c) disposing a dial on a visible region of the fitness machine, the dial being rotatable about an axis and having a display perceptible by a human user;

(d) connecting a computer to the dial and said first, second and third prime movers;

(e) the computer receiving information from the dial regarding dial orientation;

(f) the computer sending display information to the dial that is displayed by the dial's perceptible display;

(g) the computer actuating at least one of the first and second prime movers according to the information received from the dial to insert one of said at least first and second pins into a respective one of the apertures to connect at least one of the weights; and (h) actuating the third prime mover, prior to actuating one of the first and second prime movers, in order to retract from insertion any of the first and second pins.

* * * * *